US006213761B1

(12) United States Patent
Schmidt

(10) Patent No.: US 6,213,761 B1
(45) Date of Patent: Apr. 10, 2001

(54) HEATING APPARATUS

(75) Inventor: Franklin T. Schmidt, Mulvane, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/371,167

(22) Filed: Aug. 10, 1999

(51) Int. Cl.[7] ..... F23D 14/12; F23D 14/14; F23D 14/18

(52) U.S. Cl. ..... 431/328; 126/92 AC; 431/344; 431/354

(58) Field of Search ..... 431/326, 328, 431/329, 344, 354, 355, 268; 126/92 R, 92 AC, 92 B, 38, 39 E

(56) References Cited

U.S. PATENT DOCUMENTS

| | | | | |
|---|---|---|---|---|
| 1,818,471 | * | 8/1931 | Geaugue | 431/355 |
| 3,200,809 | * | 8/1965 | SuchowoleC | 16/92 B |
| 3,322,179 | * | 5/1967 | Goodell | 126/92 R |
| 3,330,267 | * | 7/1967 | Bauer | 126/92 B |
| 4,419,074 | * | 12/1983 | Schuetz | 431/354 |
| 4,533,318 | * | 8/1985 | Buehl | 126/92 AC |
| 5,060,629 | * | 10/1991 | Sirand | 126/92 B |
| 5,251,609 | * | 10/1993 | Thibault et al. | 126/39 J |
| 5,470,225 | * | 11/1995 | Fujiwara et al. | 431/354 |
| 5,601,357 | * | 2/1997 | Rangarajan | 431/344 |
| 5,646,043 | * | 7/1997 | Long et al. | 126/92 AC |
| 5,716,203 | * | 2/1998 | Sirand | 126/92 B |

FOREIGN PATENT DOCUMENTS

| | | | | |
|---|---|---|---|---|
| 0035797 | * | 9/1981 | (JP) | 431/329 |
| 57-164213 | * | 10/1982 | (JP) | 431/10 |
| 61-86509 | * | 5/1986 | (JP) | 431/329 |

* cited by examiner

*Primary Examiner*—Carl D. Price
(74) *Attorney, Agent, or Firm*—Kramer Levin Naftalis & Frankel LLP

(57) ABSTRACT

A heating apparatus for combusting a fuel-air mixture which includes a combustion chamber with an inlet at one end and a combustion outlet at the other end, a catalyst-containing substrate disposed in the combustion chamber, a fuel supply in communication with the inlet for supplying fuel, and a fuel-air mixing assembly for providing a uniform fuel-air mixture to the combustion chamber. The mixing assembly includes one or more openings for drawing a controlled proportion of primary air which is mixed with the fuel and combusted in the combustion chamber. The use of primary air improves efficiency and reduces the reliance on secondary air. Limiting the proportion of primary air to approximately 15–20% of the stoichiometric mass of air required substantially reduces the emission of hazardous combustion by-products such as carbon monoxide.

5 Claims, 8 Drawing Sheets

HEATING APPARATUS

FIELD OF THE INVENTION

The present application relates generally to heating devices, particularly to heating devices in which a highly efficient catalytic combustion apparatus is employed to generate heat from a vaporous fuel with reduced toxic emissions.

BACKGROUND INFORMATION

A typical catalytic combustion apparatus oxidizes a gaseous fuel, such as methane, butane or propane, at room temperature to generate heat. Generally, the fuel is introduced into a gas-tight housing where the fuel expands to completely fill the housing. As the fuel diffuses through a catalyst-containing support located at an outlet of the housing, ambient air mixes with the diffused fuel. The fuel-air mixture is then oxidized by a reaction promoted by the catalyst to produce heat. Such catalysts typically include noble metals such as platinum group metals or compounds containing the same. The substrates upon which the catalysts are supported are typically made from glass fibers, porous metals or ceramics such as ceramic wool or ceramic board and the like.

The products of the catalyst-enhanced oxidation reaction, such as carbon dioxide and water vapor, are discharged through the outside surface of the catalyst-containing substrate. Convection currents disperse the reaction products and draw in ambient air to provide oxygen to sustain the reaction. The reaction is normally started by igniting the reactants, by means of a flame (e.g. a pilot light) or a spark induced, for example, by an electrical ignition.

A drawback of such known combustion apparatuses is reliance on convection currents to circulate the reactants (air and fuel) and to remove combustion products from the catalyst-containing reaction zone. A factor which contributes to controlling the rate of oxygen available per unit area of catalyst is the rate of convection flow over the active catalytic surface. Convection currents often produce irregular and erratic flows of reactants over the active catalytic surface. Under such conditions, there is typically an uneven distribution of oxygen and/or fuel within the reaction zone containing the catalyst. Consequently, when oxygen is available in less than a stoichiometric amount relative to the fuel, incomplete combustion of the fuel occurs resulting in harmful by-products including carbon monoxide, unburned fuel and the like. As carbon monoxide and unreacted fuel accumulate, a dangerous health hazard arises that could result in serious injury or death to occupants of an enclosed space in which the heating apparatus is used.

SUMMARY OF THE INVENTION

The present invention is generally directed to a heating apparatus comprising a fuel source and an air inlet in communication with a mixing means for creating a uniform fuel-air mixture with a desirable ratio of air to fuel, before being combusted in a catalyst-containing combustion chamber for generating heat. Such pre-mixing of the fuel and air provides for a cleaner and more efficient heat generating combustion resulting in substantially reduced emissions of toxic substances such as carbon monoxide, unreacted fuel and the like, increased safety and an improved operating life of the apparatus.

In particular, one aspect of the present invention is directed to a heating apparatus which includes a combustion chamber having an inlet for receiving a uniform fuel-air mixture, and an outlet. The combustion chamber further includes a catalyst-containing substrate for initiating combustion of the fuel-air mixture. A fuel source and an air inlet are provided in communication with a mixing means for mixing the fuel and air under conditions which provide for a uniform fuel-air mixture, and for delivering the uniform fuel-air mixture through the inlet to the substrate in the combustion chamber to produce heat with minimal production of harmful by-products.

DETAILED DESCRIPTION

The present invention provides for a heating apparatus useful for generating heat through the catalytically accelerated reaction of a gaseous or vaporizable fuel and air mixture. The heating apparatus of the present invention can be used as a space heater for a variety of locations including tents, homes, factories, caravans, hatcheries, greenhouses, drying rooms and the like. The heating apparatus is constructed with the advantage of creating a uniform fuel-air mixture having a desirable air to fuel ratio. Such controlled pre-mixing of fuel and air provides for a cleaner and more efficient heat generating combustion resulting in substantially reduced emissions of toxic substances such as carbon monoxide, unreacted fuel and the like, increased safety, and improved operating life of the apparatus. With substantially reduced toxic emissions, the heating apparatus of the present invention provides for a safe, reliable and highly efficient direct heating system.

The heating apparatus of the present invention may be used with gaseous fuels having a vapor pressure greater than one atmosphere at room temperature (i.e. 20° C.), such as for example, methane, ethane, propane and butanes, and olefines such as propylene and butenes and mixtures thereof. Commercially available fuels such as natural gas, town gas, liquified natural gas, liquified petroleum gases and various waste hydrocarbon gases are suitable as well including mixtures thereof. The present invention is also applicable to vaporizable fuels (i.e. liquid fuels which may be formed into fine droplets) such as kerosene and other liquid hydrocarbon fuels which can be vaporized, or to permanent gas fuels such as hydrogen, which may be diluted with an inert gas such as nitrogen to control the temperature of combustion.

Figure 1:
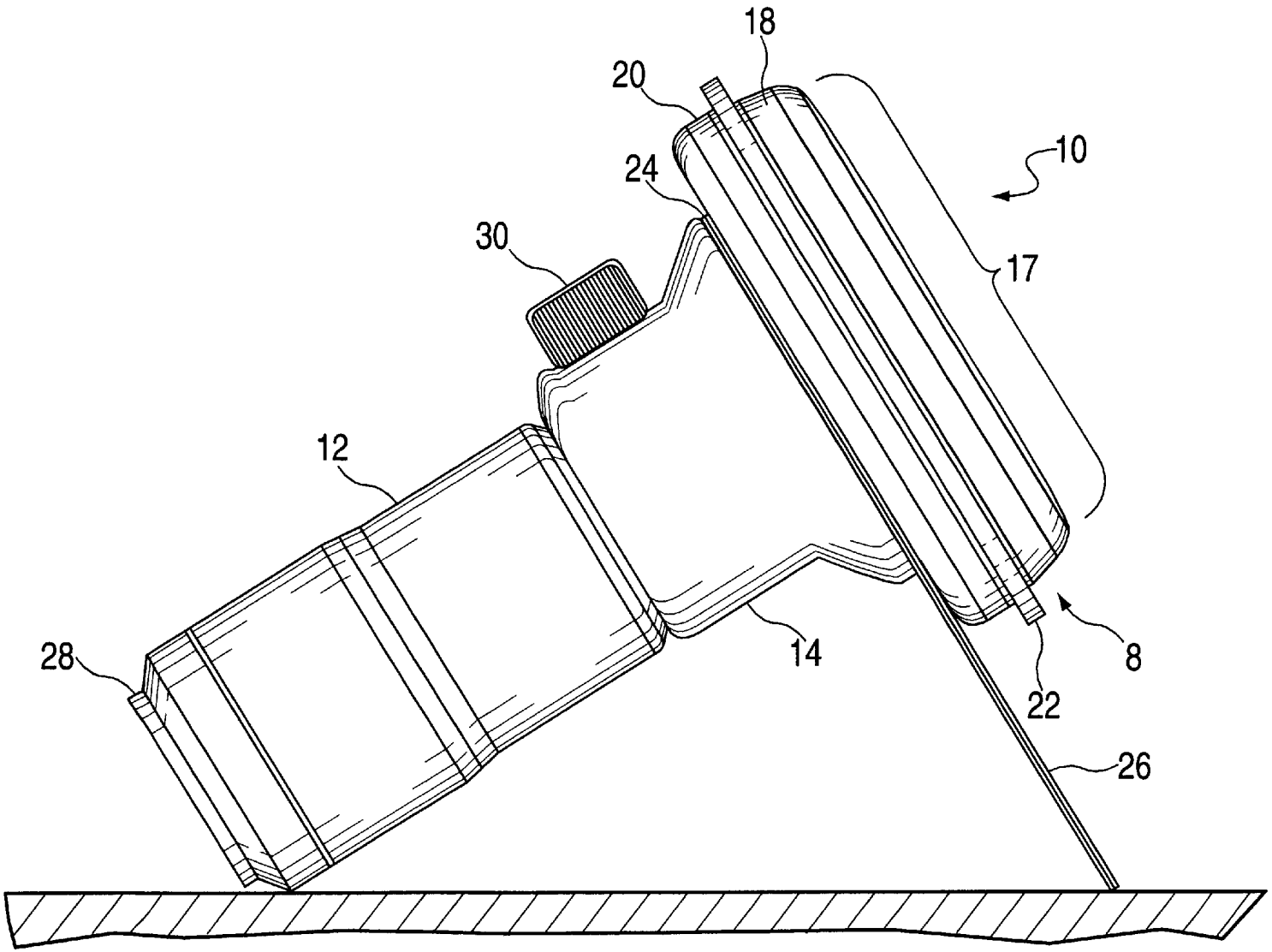
FIG. 1 is a side elevational view of an exemplary embodiment of a heating apparatus of the present invention.

Referring now to the drawings, and particularly FIG. 1, an embodiment of a heating apparatus in accordance with the present invention is shown, in which a fuel such as propane is supplied under pressure from a fuel canister to a combustion chamber containing a catalyst substrate where the fuel reacts with oxygen in the presence of the catalyst under conditions and in a manner where heat is generated while eliminating or at least minimizing the presence of harmful by-products arising from incomplete combustion of fuel.

FIG. 1 illustrates a portable heating apparatus coupled to a fuel canister containing a fuel in a form suitable for efficient reacting with oxygen to generate heat. The term "fuel" shall include gaseous fuels (e.g. propane), vaporizable fuels such as kerosene, and mixtures thereof. The heating apparatus 10 generally includes a housing 8 defining a combustion chamber 16 therein (see FIG. 2). It should be noted that the housing 8 may be in a variety of shapes, including the shape of a cylinder, a rectangular solid and the like. Other shapes and sizes may be utilized depending on the application as will be recognized by one of ordinary skill in the art.

The combustion chamber 16 includes an outlet 17, and an inlet in fluid communication with a fuel canister 12 through a regulator valve assembly and a fuel-air mixing assembly as will be described hereinafter. A substantially cylindrical collar 14 with a wider portion at the end opposite from the fuel canister 12, is included for housing the regulator valve and fuel-air mixing assemblies. A knob 30 is connected to the regulator valve assembly for regulating the flow rate of fuel from the fuel canister 12 into the combustion chamber 16, as will be described hereinafter. A heat shield 24 may be optionally provided between the collar 14 and the housing 8 to prevent the transmission of heat from the housing 8 to the other components of the apparatus 10.

The housing 8 includes a gas permeable head screen 18 and a head pan 20. The head screen 18 encloses the outlet 17 for safety purposes, i.e. preventing serious skin burns. In addition, the head screen 18 physically protects components within the combustion chamber 16. The head screen 18 may comprise a mesh or a plurality of holes or other openings. In an exemplary embodiment, approximately 80% of the area of the head screen is open. The head screen 18 and the head pan 20 are securely fastened together by an annular clamp 22 which extends along the respective common peripheries for forming a gas-tight seal therebetween. A catalyst-containing substrate 32 is disposed in the combustion chamber 16 between the head screen 18 and the head pan 20.

The introduction of the fuel-air mixture into the housing 8 under pressure and in a uniform fashion dramatically improves the operation of the heating apparatus 10 at various angles and orientations. With little effect on overall performance, the apparatus 10 can effectively operate in a vertical position resting on a base portion 28 of the fuel canister 12 or at a position such as 45° from vertical while supported by a leg stand 26.

Figure 2:
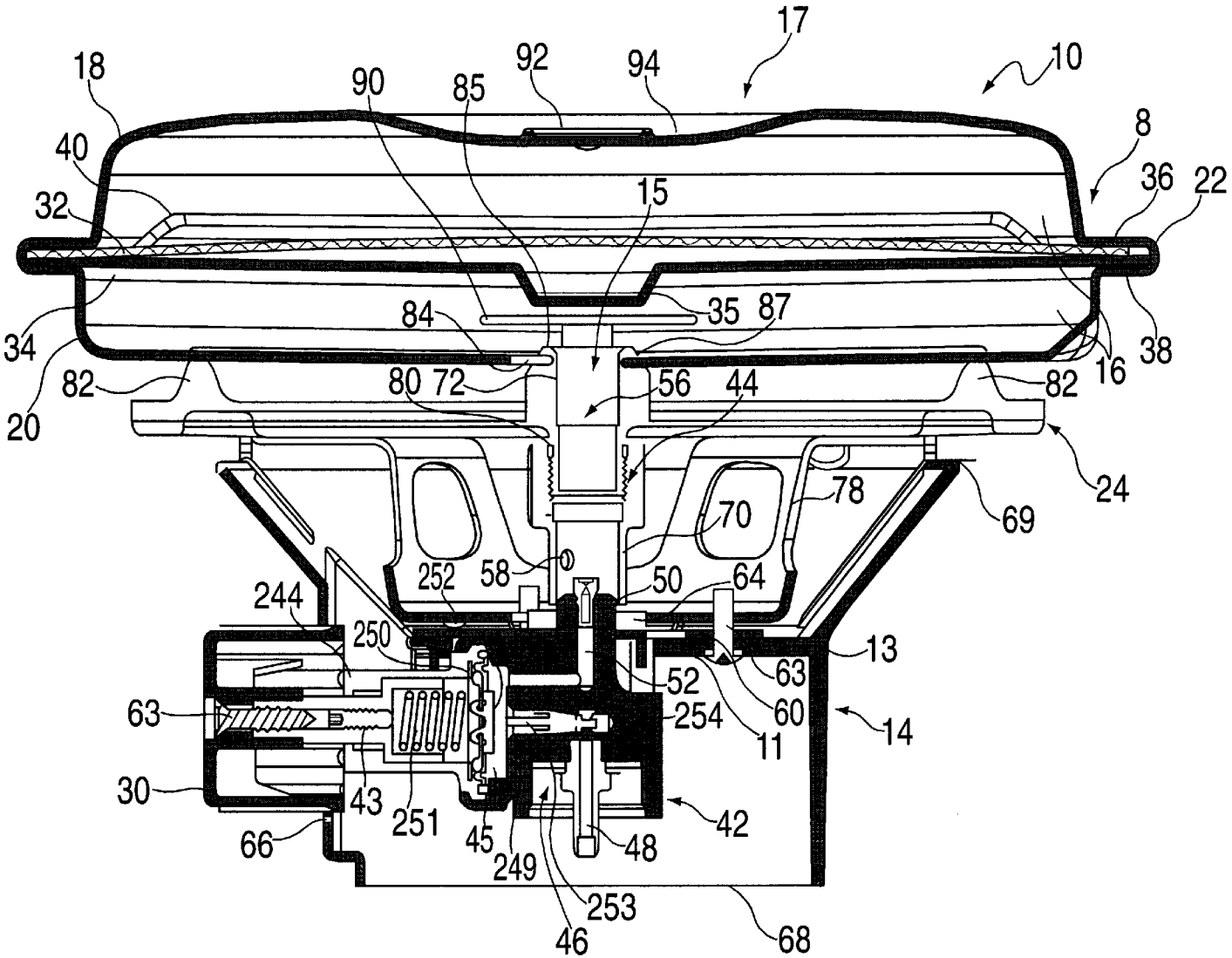
FIG. 2 is a side cross-sectional view of the heating apparatus of FIG. 1.

Referring to FIG. 2, the fuel is introduced into the lower portion of the combustion chamber 16 in the housing 8 via a regulator valve assembly 42 and a fuel-air mixing assembly 44. An inlet port 46 of the regulator valve assembly 42 is configured for receiving and coupling with a fuel supply means such as the fuel canister 12 shown in FIG. 1. The pressurized fuel is introduced into the inlet port 46 through an inlet tube 48, which extends into the regulator valve assembly 42. A fuel regulator assembly 249 is provided at the end of the inlet tube 48 for regulating the fuel flow through the regulator valve assembly 42 in accordance with the position of the adjust knob 30 attached thereon, as will be described hereinafter. As the regulated fuel passes through the fuel regulator assembly 249, it exits the regulator valve assembly 42 through an outlet tube 52 in an outlet port 50 which extends into the fuel-air mixing assembly 44.

The fuel-air mixing assembly 44 is defined by an elongated tubular member comprising upper and lower tubes 72 and 70, respectively. It should be noted that the tubes 72, 70 of the fuel-air mixing assembly 44 may be of a unitary structure for ease of assembly. The elongated tubular member includes a bore 56 in communication with the outlet port 50 of the regulator valve assembly 42 at one end and the inlet 15 of the combustion chamber 16 at the other end. During operation, as fuel under pressure flows rapidly through the bore 56, a low pressure gradient is produced therein relative to the ambient air pressure. An opening 58 in the lower tube 70, proximate to the regulator valve assembly end of the fuel-air mixing assembly 44 admits ambient air into the fuel stream, i.e., air is drawn into the low pressure area of the fuel stream for mixing therewith. More than one opening 58 may be included. The size of the opening 58 and the diameter of the bore 56 are proportioned such that a specific amount of primary air is mixed with the fuel. Depending on the fuel consumption rate and the heat output of the heater, approximately 10 to 20% (preferably 10–15%) of the air required for proper stoichiometric fuel-air combustion is preferably introduced through the opening 58 into the fuel stream. The remaining 80–90% of the combustion air is drawn as secondary air at the head of the heater 10. By limiting the amount of primary air intake to the above specified range, the risk of experiencing an explosive build-up of primary air in the lower portion of the combustion chamber 16 is eliminated or at least substantially minimized. In addition, the emission levels of harmful combustion by-products are further kept to a minimum.

Fuel and air entering the housing 8 into the lower portion of the combustion chamber 16 are radially diffused from the center by a diffuser plate 90, which is preferably circular (see also FIG. 5), mounted above the inlet 15. The purpose of the diffuser plate 90 is to ensure a thorough mixing and blending of the primary air with the fuel in the combustion chamber 16 and to facilitate a uniform flow of the fuel-air mixture through the catalyst-containing substrate 32 over the entire area thereof. A uniform fuel-air mixture flow ensures an efficient and complete combustion and prevents hot spots from developing on the surface of the catalyst-containing substrate 32. Hot spots shorten the operating life of the catalyst-containing support 32, degrade the catalyst, result in incomplete combustion, and decrease the overall efficiency of the apparatus 10.

As the uniform fuel-air mixture permeates throughout the combustion chamber 16, the mixture flows through an inner screen 34. The inner screen 34 provides a base support for the porous catalyst-containing substrate 32 to preserve its substantially planar shape and prevent any distortions, e.g., center portion bowing downwardly. A deformed catalyst-containing support 32 creates hot spots in the surface thereof which can degrade overall performance and operating life of the apparatus 10. A centrally-located, generally circular depression 35 in the inner screen 34 extends downwardly towards the top surface of the diffuser plate 90. During operation, the circular depression 35 acts as a thermal conductor for transmitting heat from the catalyst-containing substrate 32 to the diffuser plate 90. The heated diffuser plate 90 in turn acts as a heatexchanger for heating the incoming fuel-air mixture, which slightly raises the pressure gradient in the combustion chamber 16 for total saturation of the catalyst-containing substrate 32. An increase in gas pressure further facilitates the uniform distribution and flow of the fuel-air mixture along the entire length of the catalyst-containing substrate 32, even when the apparatus is oriented at an angle such as 45° from vertical.

The catalyst-containing substrate 32 is a woven fabric-like ceramic pad composed of materials such as aluminum silicon, zirconia, titania, silica and alumina and mixtures thereof that is porous for facilitating gas diffusion and refractory for resisting the heat accompanying combustion. The catalyst-containing substrate 32 further includes a catalyst material composed of a noble metal such as platinum and compounds there of which facilitates the oxidation of the fuel-air mixture to generate a flameless combustion.

As the uniform fuel-air mixture flows into the catalyst-containing substrate 32, the balance of the ambient air, or secondary air, required for complete combustion circulates throughout the surface of the catalyst-containing substrate 32. There the uniform fuel-air mixture is oxidized by the catalyst-containing substrate 32 for a clean and efficient reaction.

Figure 3A:
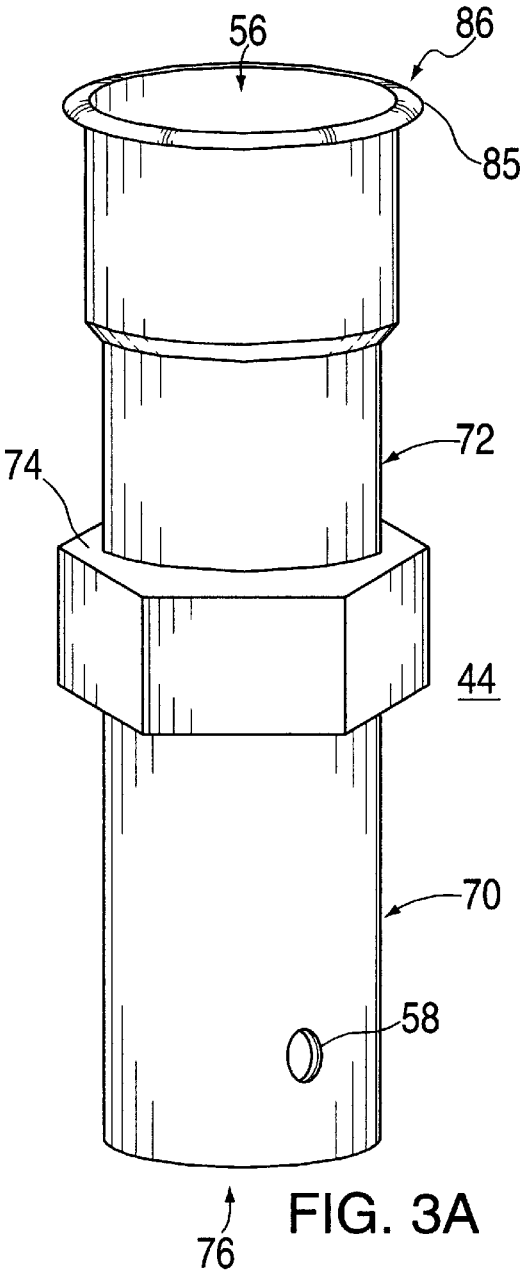
FIG. 3A shows an enlarged perspective view of an embodiment of a fuel-air mixing assembly for use in the present invention.
Figure 3B:
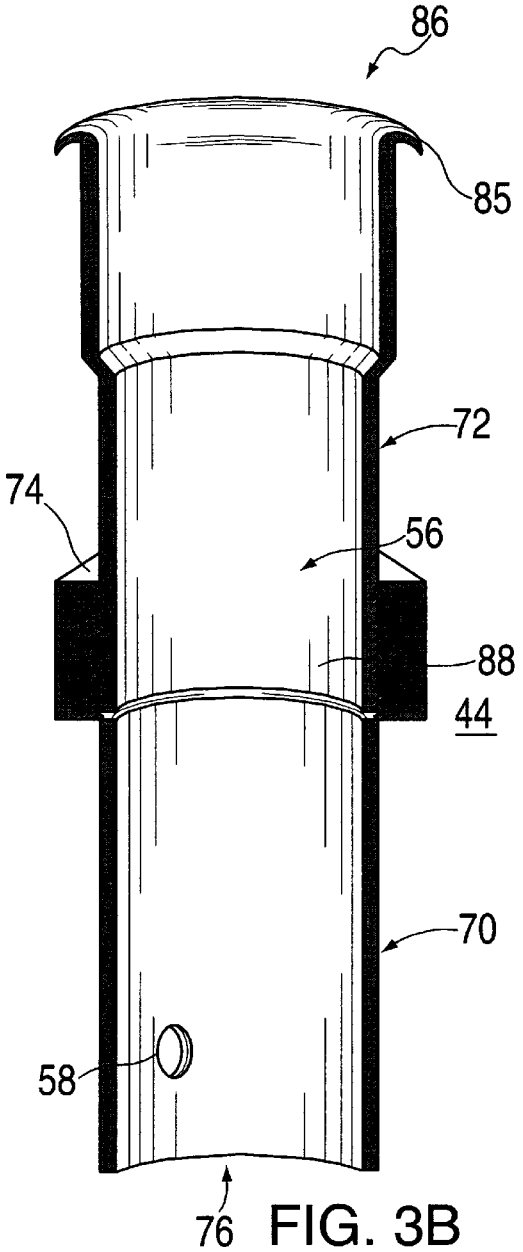
FIG. 3B shows an enlarged longitudinal cross-sectional view of the fuel-air mixing assembly shown in FIG. 3A.
Figure 3C:
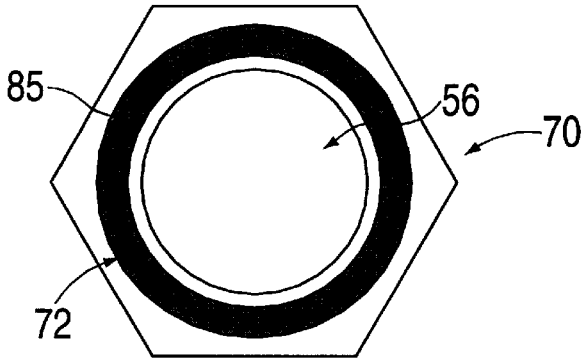
FIG. 3C is an enlarged top plan view of the fuel-air mixing assembly shown in FIG. 3A.

A more detailed view of the fuel-air mixing assembly 44 is shown in FIGS. 3A through 3C. As described above, the fuel-air mixing assembly 44 is a tubular member, preferably having a circular cross-section, comprised of a lower tube 70 connected to an upper tube 72, such as by threaded engagement. The bore 56 is cylindrically shaped for permitting fuel to flow therethrough. Radially directed openings 58 are provided in the surface of the lower tube 70 for drawing ambient air therein for mixing with the fuel stream. The length of the fuel-air mixing assembly 44 should be such that thorough mixing and blending of the fuel and the air can be achieved.

Figure 4A:
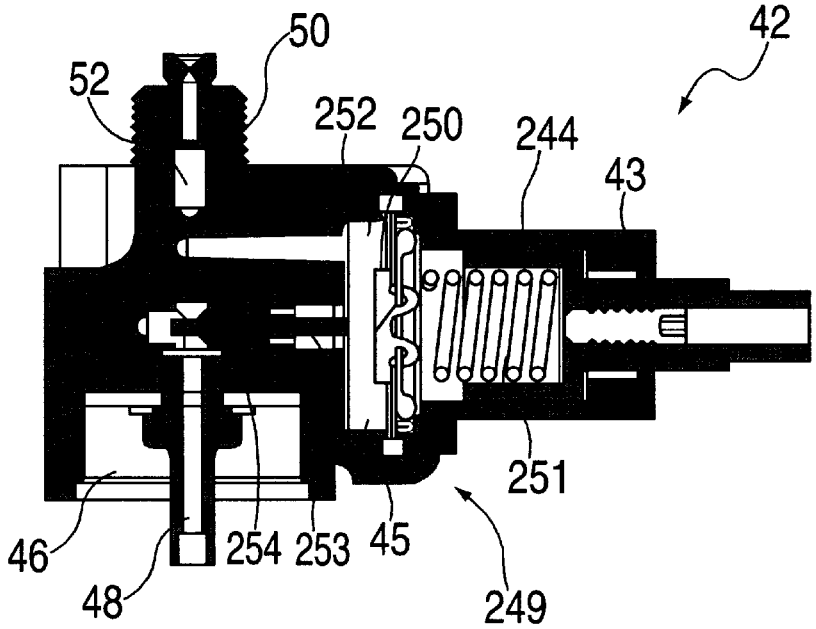
FIG. 4A is an enlarged cross-sectional elevational view of one embodiment of a regulator valve assembly for use in the present application.

Referring to FIG. 4A, an enlarged side cross-sectional view of the regulator valve assembly 42 is shown in greater detail. The regulator valve assembly 42 provides a means for regulating the fuel flow into the heating apparatus 10. As mentioned above, the regulator valve assembly 42 primarily includes an inlet port 46, an outlet port 50, and the fuel regulator assembly 249 attached to the knob 30. The inlet port 46 is configured for receiving fuel from the fuel canister 12 as described above, and the outlet port 50 is fluidly coupled to the fuel-air mixing assembly 44 for discharging the fuel therein.

The fuel regulator assembly 249 includes a valve core 254 coupled with the inlet tube 48. The valve core 254 opens and shuts the regulator valve assembly 42 for regulating the fuel flow rate. A stem 253 slidably connected to the valve core 254 triggers the opening and shutting of the valve core 254. The fuel regulator assembly 249 further includes a diaphragm assembly 250 disposed within the regulator valve assembly 42 proximate the valve core 254. The diaphragm assembly 250 is composed of a flexible material customarily employed for diaphragms such as rubber, elastomer, latex, polypropylene, and the like that permits back and forth movement in relation to the stem 253 and the valve core 254. A member 252 typically in the shape of a button is disposed in the diaphragm assembly 250 for engagement with the valve core stem 253 when a pressure is applied against the diaphragm assembly 250. An actuator 43 connected to the knob 30, radially engages a cam collar 244. As the actuator 43 is radially turned, the actuator 43 slides back and forth in response to the cam profile (see FIG. 4B and the description hereinafter) of the cam collar 244. This sliding movement of the actuator 43 causes the tension in a spring 251 to vary as it presses against the diaphragm assembly 250 for operative engagement with the valve core 254. The higher the spring tension, the greater the rate of fuel flow through the valve core 254.

The regulator valve assembly 42 further provides a pulsating fuel flow to the heating apparatus 10. With the diaphragm assembly 250 spring-biased against the stem 253 during operation, the valve core 254 opens for permitting fuel to flow therethrough. The flowing fuel overcomes the spring pressure and the diaphragm assembly 250 is temporarily displaced off of the valve core stem 253, causing the valve core to close. With the valve core 254 thus closed, the pressure in the chamber 45 subsides and the diaphragm assembly 250, biased by the spring 251, presses against the valve core stem 253 once again, causing it to open. This pattern produces a continuous oscillation of the diaphragm assembly 250 which results in the pulsing of the fuel flow. The amount of fuel associated with each oscillation is dependent at least in part on the tension of the spring 251. The pulsing action provides an added benefit of aiding in the mixing of the fuel-air mixture primarily in the fuel-air mixing assembly 44.

Figure 4B:
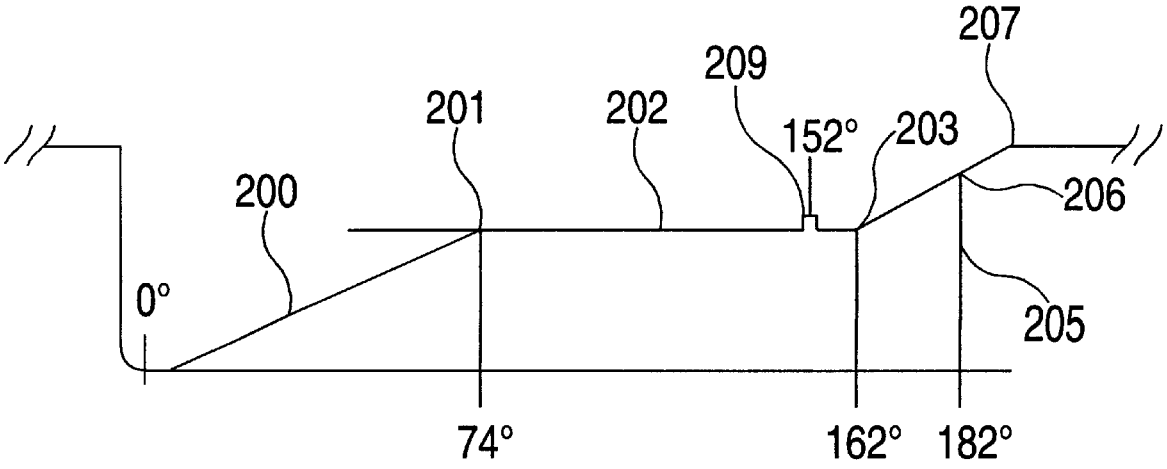
FIG. 4B is a graphical representation of a preferred profile of the fuel flow rate generated by the regulator valve assembly shown in FIG. 4A.

Referring to FIG. 4B, a graphical representation of fuel flow rate relative to the cam profile of the cam collar 244 is shown. The regulator valve assembly 42 operates in three principal stages, one of which is transitory for providing maximal fuel flow during ignition, and referred to as the IGNITE stage. The other two positions include OFF and ON. At 0°, the regulator valve assembly 42 is in the OFF position which is characterized by the closure of the valve core 254 and the absence of fuel flow. In this position, the actuator 43 is at its furthest point away from the diaphragm assembly 250 and the tension of the spring 251 is thus at its lowest.

As the actuator 43 is rotated along the cam collar 244 from 0° to a first activation position 201 (e.g. about 74°), the actuator moves inward linearly, as shown by a ramp segment 200, with the tension of the spring 251 increasing accordingly and the valve core 254 opening accordingly. Beyond the first position 201, the fuel flow rate remains substantially constant as the actuator is rotated (through the horizontal ramp segment 202) to a second position 203. The ramp segment 202, between about 74° and about 162°, represents the ON stage in which the valve core 254 is open sufficiently (e.g., 75% of capacity) for providing normal operating fuel flow.

To advance to the IGNITE stage, the actuator 43 is turned beyond the ON stage to a third activation position 206 (e.g. about 182°). At the position 206, the valve core 254 is open at an increased capacity for permitting additional fuel flow therethrough.

The increased fuel flow rate facilitates the ignition of the combustion reaction in the heating apparatus 10. Once the apparatus 10 is ignited, the user releases the knob 30 and the actuator 43 being biased by the spring 251, rotates back to the ON stage for restoring the fuel flow to the normal operating rate.

Stopping features (not shown) arranged on the actuator 43 and collar 244, in a known way, prevent the actuator from advancing beyond the position 206. As shown in FIG. 4B, position 206 is located along an inclined ramp 205. By thus locating the position 206 along an incline, it is ensured that the actuator 43, under the biasing force of the spring 251, will rotate back down to the ON position when the knob 30 is released.

A hump 209 is provided on the cam profile of the collar 244 at a position on the ramp segment 202 (e.g. about 152°) to prevent the actuator 43 from turning beyond the ON stage without user intervention. As such, once the heater has been lit and the user releases the knob 30 from the IGNITE position, the actuator 43 rotates back to the ON stage and is captured between the hump 209 and the position 203. To turn the heater off, the user rotates the actuator 43 over the hump 203, across the ramp segment 202 and down the ramp segment 200, back to the OFF position.

Figure 5:
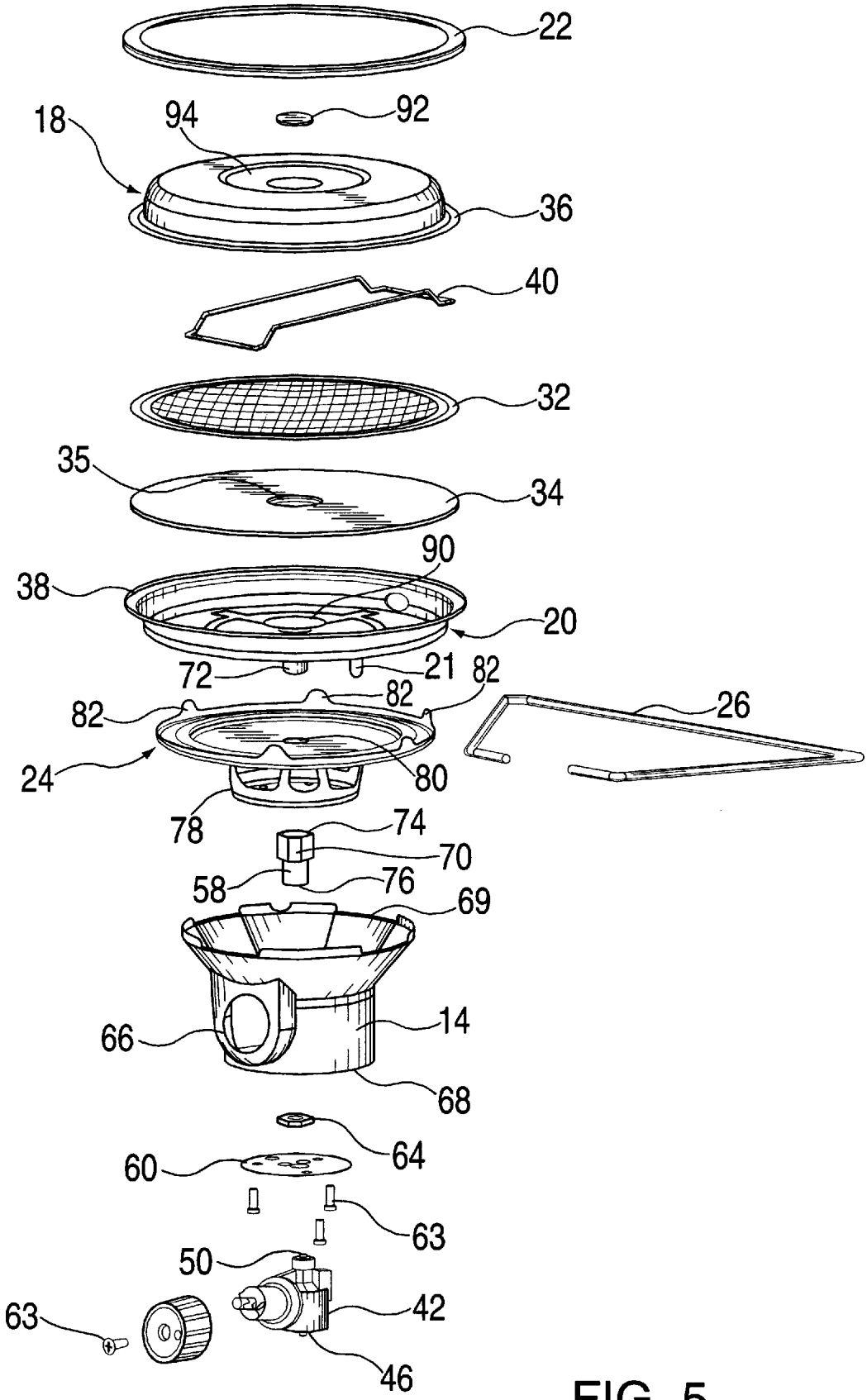
FIG. 5 is an exploded view of an embodiment of the heating apparatus of the present invention.

Referring to FIG. 5, an exploded view of an exemplary embodiment of the heating apparatus 10 of the present invention is shown. The regulator valve assembly 42, including the internally threaded inlet port 46, the externally threaded outlet port 50 and the actuator 43, is coupled with a regulator plate 60 through a centrally located hole 62 and secured therewith by a nut 64 threadedly engaged to the outlet port 50. The regulator plate 60 and regulator valve assembly 42 are inserted through a bottom opening 68 of the collar 14 and mounted to a partition 13 with a centrally located partition hole 12 (see FIG. 2). The regulator valve assembly 42 is oriented with the end of the actuator 43 visible through an opening 66 in the collar 14. The knob 30 is then securely affixed to end of the actuator 43 such as with a screw 63. The outlet port 50 of the regulator valve assembly 42 partially extends through the partition hole 12.

A lower tube 70 having a internally threaded top end 74 with a nut-shaped exterior, and a bottom end 76, is inserted through a top opening 69 in the collar 14. The bottom end 76 of the tube 70 is fluidly coupled with the outlet port 50 of the regulator valve assembly 42. A cylindrical bracket 78 extending from the bottom of the heat shield 24 is inserted through the top opening 69 and mounted with the collar partition 13. Three screws 63 are inserted through the bottom opening 68 in the collar 14 to tightly secure the regulator plate 60 and the bracket 78 to the partition 13.

As shown in FIGS. 3A and 3B, an upper tube 72 having a flange 85 extending around the opening at the top end 86 and an externally threaded bottom end 88, is inserted through a centrally located hole 84 in the head pan 20 (see FIG. 2). The flange 85 abuts against an edge portion 87 of the hole 84 for retaining the upper tube 72 therein and for forming a gas tight seal therebetween. The head pan 20 is placed on top of a plurality of support tabs 82 extending along the periphery of the heat shield 24. The bottom end 88 of the upper tube 72 extends through the hole 80 in the heat shield 24. The bottom end 88 is then screwed into the top end 74 of the lower tube 70 for fluid communication therebetween and for securely retaining the head pan 20 to the top of the heat shield 24. A lock tab 21 is provided under the head pan 20 for fitting engagement with a slot (not shown) in the heat shield 24. The lock tab 21 serves to immobilize the assembled housing 8, heat shield 24, and the upper tube 72 together for secure engagement. For increasing the support and stability of the heating apparatus 10, the triangular leg stand 26 is pivotally attached to the bottom portion of the heat shield 24 by the ends thereof.

Referring again to FIG. 5, the diffuser plate 90 is mounted to a top surface of the head pan 20 at a distance over the opening in the top end 86 of the upper tube 72. The head pan 20 further includes a flange portion 38 extending along the rim thereof. A permeable inner screen 34 is placed in the head pan 20 supported along the flange portion 38 thereof. A woven fabric-like catalyst-containing substrate 32 is placed on top of the inner screen 34. A holder 40 is placed transversely across the top of the catalyst-containing substrate 32 for secure retainment. The head screen 18 having a flange portion 36 extending along the rim thereof, is then placed on top of the head pan 20 for containing the holder 40, the catalyst-containing substrate 32, and the inner screen 34. The annular clamp 22 secures the respective flange portions 38 and 36 of the head pan 20 and head screen 18 together for secure retainment and gas-tight seal therebetween. Accordingly, the retained head screen 18 and head pan 20 in combination, hold the inner screen 34, catalyst-containing substrate 32 and support holder 40 in position within the combustion chamber 16.

A thermal indicator disc 92 may be provided in the center of a concave portion 94 of the head screen 18. Due to the low temperature combustion and flameless nature of the apparatus 10, there is no visual indication of heat when the apparatus is operating. A user who touches the head screen 18, not knowing whether the apparatus 10 is operating or not, could potentially incur severe burns. The thermal indicator disc 92 alerts such users to the operating status of the apparatus 10 and may thereby prevent potential injury. The thermal indicator disc 92 performs such a function by changing colors as the head screen 18 heats up to the operating temperature. Common for thermochromatic materials, the color scheme may be coordinated with various specific temperature gradients. For example, at ambient temperature the thermal indicator disc may be black. At 160–170° F., the color changes from black to red, and at the operating temperature of 200–300° F., a white sunburst mark appears in the red field. It should be noted that a wide variety of colors or words (e.g. Caution Hot) may be utilized to provide the user with a warning as to the operating status of the apparatus 10. In addition, other forms of thermal indicators employing mechanisms such as bimetallic material, for example, may be utilized for the purposes described above.

In an exemplary embodiment of the present invention, the heater apparatus 10 provides about 3,000 BTU of heat with a fuel flow rate range of about 75 to 82 cubic centimeters per minute. The air opening 58 in the fuel air-mixing assembly 44 is about 0.14 inches in diameter and the cross-sectional diameter of the fuel-air mixing assembly 44 is about 0.5 inches. The housing 8 has a cross-sectional diameter of about 8 inches with the surface of the head screen 18 radiating about 72 BTU per square inch. The carbon monoxide emission characteristic of this embodiment of the heating apparatus 10 is about 15 parts per million, even in a reduced oxygen environment. This is compared to 80 to 150 parts per million of carbon monoxide generated by a prior art catalytic combustion apparatus and 30 to 35 parts per million of carbon monoxide generated by a typical lit cigarette. It is noted that the measurements provided herein are not meant to be limiting and provide only one example of a preferred embodiment of the invention.

Figure 6A:
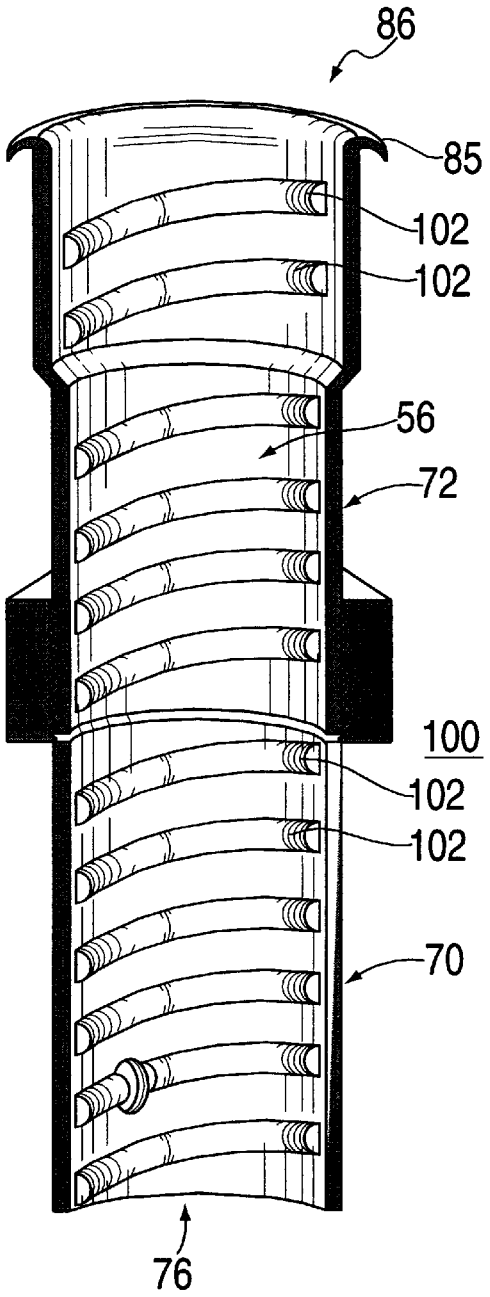
FIG. 6A is an enlarged cross-sectional elevational view of another embodiment of a fuel-air mixing assembly with a helical structure disposed within the interior thereof.

A modified fuel-air mixing assembly is shown in FIG. 6A. The modified fuel-air mixing assembly 100 is comprised of a unitary tubular member with a helical structure 102 disposed within the interior. Other components and functional aspects of the fuel-air mixing assembly 100 are essentially the same as the fuel-air mixing assembly 44 previously described. The fuel-air mixing assembly 100 includes projections formed from the helical structure 102 within the bore 56 of the fuel-air mixing assembly 100, which create an improved mixing effect therein by imparting a turbulent flow of the air and fuel throughout the bore 56.

Figure 6B:
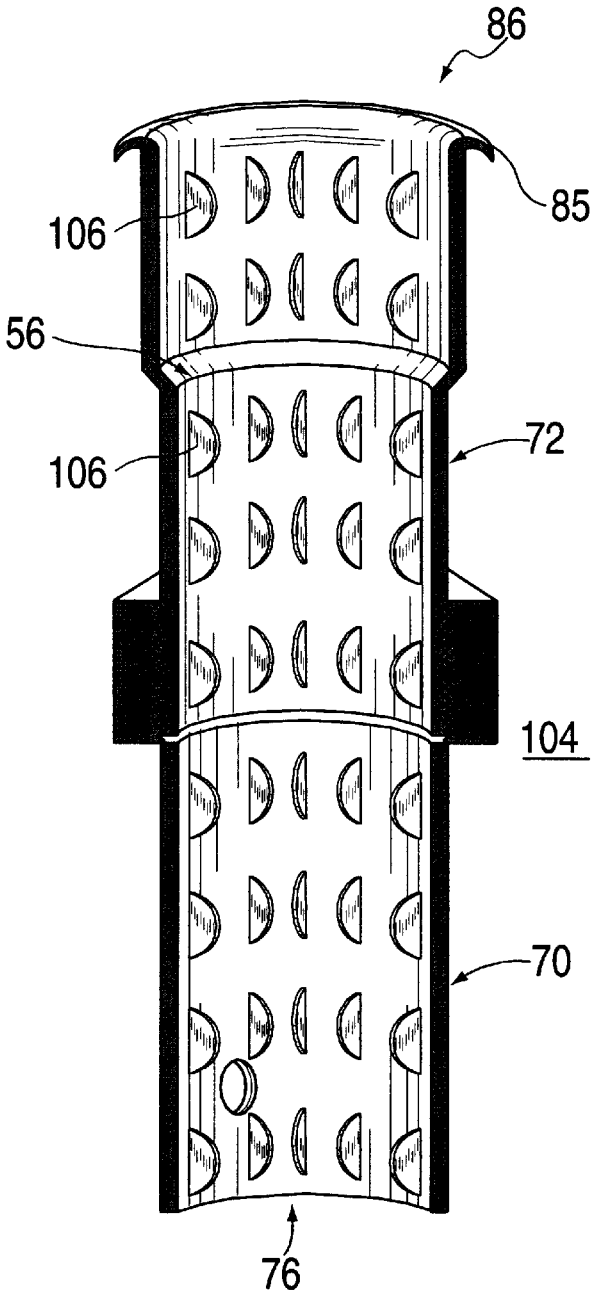
FIG. 6B is an enlarged cross-sectional elevational view of a further embodiment of a fuel-air mixing assembly with a plurality of fin-like structures affixed to the interior side walls thereof.

Another embodiment of a fuel-air mixing assembly 104 is shown in FIG. 6B which includes fin-like projections 106 adapted for the purpose of inducing turbulent flow of the fuel and air for providing a desirable uniform fuel-air mixture.

Figure 7A:
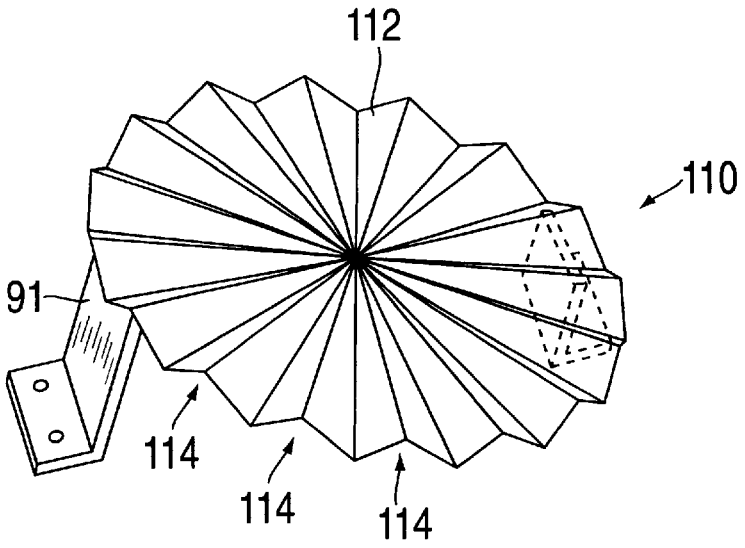
FIG. 7A is a perspective view of a modified diffuser plate for use in the present invention.
Figure 7B:
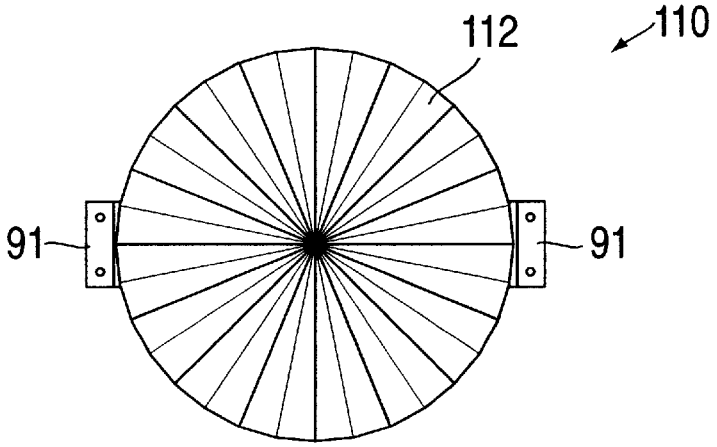
FIG. 7B shows a top plan view of the diffuser plate shown in FIG. 7A.
Figure 7C:
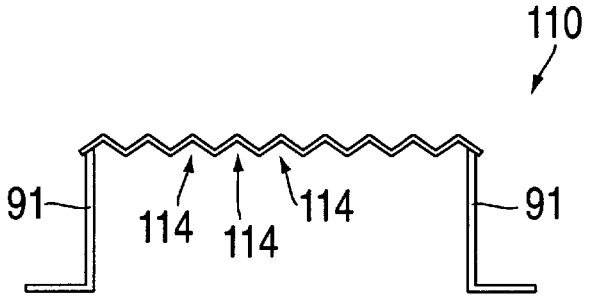
FIG. 7C shows a side elevational view of the diffuser plate shown in FIG. 7A.

As shown in FIGS. 7A through 7C, respectively, a modified diffuser plate 110 may be employed. The modified diffuser plate 110 includes a circular radially corrugated body 112 mounted to the head pan 20 by a pair of braces 91 over the chamber inlet 15. The corrugated body 112 includes a plurality of radially directed channels 114 along the lower surface thereof. The channels 114 provide for an improved uniform distribution of the fuel-air mixture within the combustion chamber 16 toward the catalyst-containing substrate 32.

Figure 8:
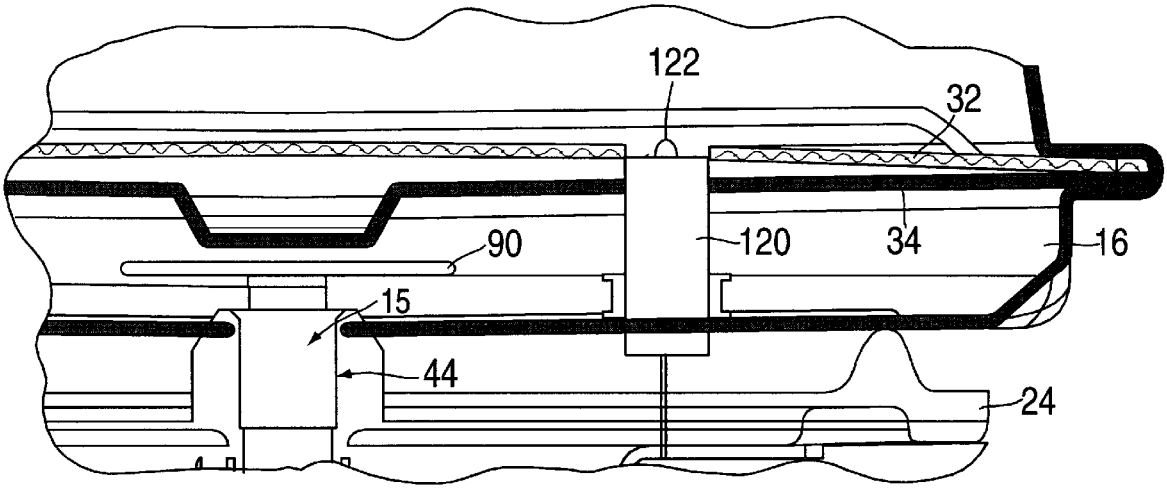
FIG. 8 is a partial cross-sectional view of an ignition assembly for use in the present invention.

In a further embodiment of the present invention as shown in FIG. 8, the combustion chamber 16 includes an electrical ignition device 120 with one end mounted to the head pan 20 and the other end having a spark emitting electrode tip 122, extending through the inner screen 34 and the catalyst-containing substrate 32. The ignition device 120 provides the user with a simple method of initiating a self-sustaining combustion reaction for generating heat. As the actuator 43 of the regulator valve assembly 42 is turned to the IGNITE position (see FIG. 4C), an initial large quantity of the fuel-air mixture is introduced into the combustion chamber 16 and thereby diffuses quickly through the catalyst-containing substrate 32. As the ignition device 122 is activated, a spark or series of sparks is created at the electrode tip 122 to ignite the denser than usual fuel-air mixture. It should be noted that the ignition device is not limited to the form described above and may include other forms such as electric, flame, and the like as known by one of ordinary skill in the art.

Figure 9A:
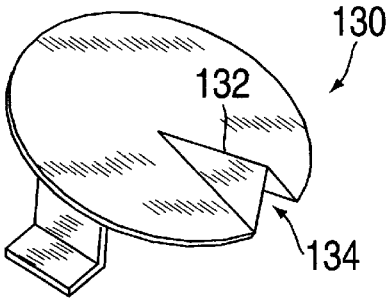
FIG. 9A is top plan view of another embodiment of a diffuser plate for use in the present invention.
Figure 9B:
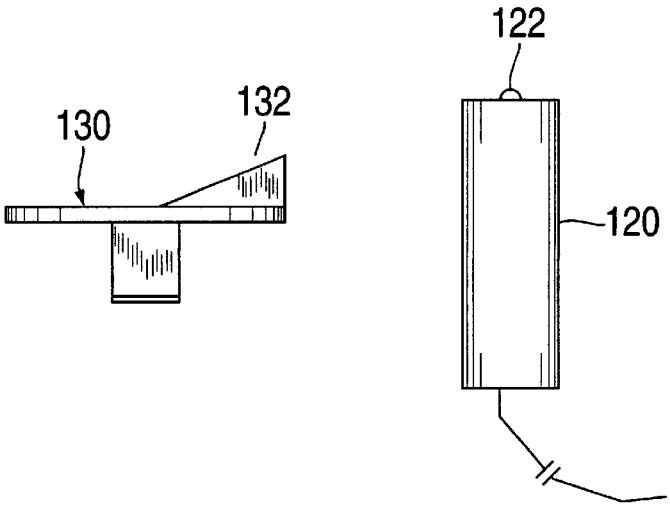
FIG. 9B is an elevational view of the diffuser plate shown in FIG. 9A in position relative to the ignition device.

In addition to the use of the ignition device 120, a modified diffuser plate 130 may be optionally included in the combustion chamber 16 as shown in FIGS. 9A and 9B. The diffuser plate 130 is similar in design to the diffuser plate 90 shown in FIGS. 2 and 8. However, the diffuser plate 130 includes an upwardly sloping ridge extending from the center to the edge of the diffuser plate 130 for forming a trough 134 in the undersurface portion thereof as shown in FIG. 9A. In mounting the diffuser plate 130 on the heat pan 20, it is preferable to orient the trough 134 towards the electrode tip 122 of the ignition device 120 as shown in FIG. 9A. Initially, during ignition, the trough 134 provides a more focused fuel-air mixture flow towards the ignition device 120 for a faster and safer ignition.

It should be understood that various changes and modifications to the presently preferred embodiments described herein will be apparent to those skilled in the art. Such changes and modifications can be made without departing from the spirit and scope of the present invention and without diminishing its attendant advantages.

What is claimed is:

1. A heating apparatus comprising:

a fuel control device, the fuel control device including an inlet for coupling to a source of fuel and including an outlet, wherein the fuel control device controls the passage of fuel from the inlet to the outlet;

an air-fuel mixer, the air-fuel mixer including an air opening for receiving primary air, a fuel opening coupled to the outlet of the fuel control device for receiving fuel and an outlet, wherein the air-fuel mixer mixes the fuel and the primary air and provides an air-fuel mixture at the outlet;

a combustion chamber, the combustion chamber including a catalyst-containing substrate, an inlet coupled to the outlet of the air-fuel mixer for receiving the air-fuel mixture, and an opening for emitting heat, wherein the combustion chamber draws secondary air during combustion; and a diffuser plate, the diffuser plate having a diameter that is substantially smaller than the combustion chamber, and being positioned within the combustion chamber over said inlet, said plate being spaced apart from said inlet a sufficient distance to form a passage, said passage enabling the uniform distribution of the fuel-air mixture along the surface of said catalyst-containing substrate, wherein during combustion the air-fuel mixer limits the primary air received so that the primary air received and the secondary air drawn by the combustion chamber are in a substantially stoichiometric relationship with the fuel in the air-fuel mixture provided by the air-fuel mixer to produce heat with a minimal amount of harmful by-products, and wherein the diffuser plate comprises a generally pleated surface.

2. A heating apparatus comprising:

a fuel control device, the fuel control device including an inlet for coupling to a source of fuel and including an outlet, wherein the fuel control device controls the passage of fuel from the inlet to the outlet;

an air-fuel mixer, the air-fuel mixer including an air opening for receiving primary air, a fuel opening coupled to the outlet of the fuel control device for receiving fuel and an outlet, wherein the air-fuel mixer mixes the fuel and the primary air and provides an air-fuel mixture at the outlet;

a combustion chamber, the combustion chamber including a catalyst-containing substrate, an inlet coupled to the outlet of the air-fuel mixer for receiving the air-fuel mixture, and an opening for emitting heat, wherein the combustion chamber draws secondary air during combustion; and a diffuser plate, the diffuser plate having a diameter that is substantially smaller than the combustion chamber, and being positioned within the combustion chamber over said inlet, said plate being spaced apart from said inlet a sufficient distance to form a passage, said passage enabling the uniform distribution of the fuel-air mixture along the surface of said catalyst-containing substrate, wherein during combustion the air-fuel mixer limits the primary air received so that the primary air received and the secondary air drawn by the combustion chamber are in a substantially stoichiometric relationship with the fuel in the air-fuel mixture provided by the air-fuel mixer to produce heat with a minimal amount of harmful by-products, and wherein the diffuser plate comprises a groove arranged radially on the diffuser plate.

3. The apparatus of claim 2, wherein the groove is directed generally toward an ignition device.

4. A heating apparatus comprising:

a fuel control device, the fuel control device including an inlet for coupling to a source of fuel and including an outlet, wherein the fuel control device controls the passage of fuel from the inlet to the outlet;

an air-fuel mixer, the air-fuel mixer including an air opening for receiving primary air, a fuel opening coupled to the outlet of the fuel control device for receiving fuel and an outlet, wherein the air-fuel mixer mixes the fuel and the primary air and provides an air-fuel mixture at the outlet; and a combustion chamber, the combustion chamber including a catalyst-containing substrate, an inlet coupled to the outlet of the air-fuel mixer for receiving the air-fuel mixture, and an opening for emitting heat, wherein the combustion chamber draws secondary air during combustion, wherein during combustion the air-fuel mixer limits the primary air received so that the primary air received and the secondary air drawn by the combustion chamber are in a substantially stoichiometric relationship with the fuel in the air-fuel mixture provided by the air-fuel mixer to produce heat with a minimal amount of harmful by-products, wherein the fuel control device includes a regulator valve assembly, the regulator valve assembly having an outlet port, an inlet port, and a fuel regulator assembly extending from a side portion of said regulator valve assembly for regulating fuel flow rate, said outlet port being coupled with said air-fuel mixer and said inlet port being configured for receiving and coupling with said fuel supply, wherein the fuel regulator assembly comprises a valve core which is reversibly movable from an open to a shut position to provide fuel to the air-fuel mixer, wherein the fuel regulator assembly comprises a diaphragm assembly, the diaphragm assembly comprising a flexible member operatively engaged between a spring means and said valve core, wherein pressure applied by the spring means to the flexible member causes the valve core to move to said open and shut positions, and wherein the regulator valve assembly includes an actuation mechanism, the actuation mechanism including an actuator and a collar, wherein a rotation of the actuator with respect to the collar is translated into an axial displacement of the actuator which varies with the rotational relationship between the actuator and the collar, and wherein the actuator is coupled to the spring means.

5. The apparatus of claim 4, wherein the collar comprises a cam profile having features of varying axial extent.

* * * * *